United States Patent [19]

Hanson

[11] Patent Number: 4,567,833

[45] Date of Patent: Feb. 4, 1986

[54] COMPOSITE CONSTANT CONTACT SIDE BEARING FOR RAILROAD CARS

[75] Inventor: Thomas L. Hanson, Hinsdale, Ill.

[73] Assignee: Holland Company, Aurora, Ill.

[21] Appl. No.: 652,835

[22] Filed: Sep. 20, 1984

[51] Int. Cl.[4] ..... B61F 5/14

[52] U.S. Cl. ..... 105/199 CB; 105/164; 267/3; 267/141; 384/423

[58] Field of Search ..... 105/199 C, 199 CB, 199 A, 105/199 R, 164; 384/594, 423; 267/3, 22 A, 63 R, 153, 140.1, 141, 141.1, 141.4

[56] References Cited

U.S. PATENT DOCUMENTS

| | | | |
|---|---|---|---|
| 2,327,954 | 8/1943 | Barrows et al. | 384/423 |
| 2,913,288 | 11/1959 | Blattner | 308/138 |
| 3,556,503 | 1/1971 | Van Moss | 267/3 |
| 3,712,691 | 1/1973 | Cope | 308/138 |
| 3,738,633 | 6/1973 | Pineau | 267/141 |
| 3,796,167 | 3/1974 | Van Moss, Jr. | 105/199 CB |
| 3,888,555 | 6/1975 | Van Moss | 308/138 |
| 3,910,655 | 10/1975 | Willison et al. | 308/138 |
| 3,932,005 | 1/1976 | Miller | 308/138 |
| 3,957,318 | 5/1976 | Wiebe | 105/199 CB X |
| 4,080,016 | 3/1978 | Wiebe | 308/138 |
| 4,133,392 | 1/1979 | Freese | 267/22 A X |

OTHER PUBLICATIONS

The Car & Locomotive Cyclopedia, 1980 Ed., pp. 738 and 739, Stucki Roller Side Bearings.

*Primary Examiner*—Robert B. Reeves

*Assistant Examiner*—Glenn B. Foster

*Attorney, Agent, or Firm*—McWilliams, Mann, Zummer and Sweeney

[57] ABSTRACT

A composite constant contact side bearing for railroad cars that comprises a body, that may be either cage mounted or free mounted, having a top wall that supports the car body bolster, a bottom wall structure that is to be supported by the truck bolster, oppositely facing side walls that extend the length of the body, and oppositely facing end walls that extend normally of the body side walls, with the body comprising a rigid filler block enclosed within a polyurethane casing that defines the body top wall, end walls, and side walls, with the filler block being of generally quadrilateral parallelepiped configuration, but defining a depending stud from its underside that protrudes from the polyurethane casing below the filler block. The filler block and stud are of one piece hollow or solid metallic construction, while the casing is of a single density polyurethane composition molded on the filler block with the orientation that the portions of same that define the body top wall, end walls and side walls are of relatively thin thickness dimensions, while below the filler block, the casing defines beneath either end of the filler block a resilient pad portion that project below the filler block in excess of the projection of the stud therefrom, with the polyurethane casing defining the compressive travel of the side bearing and the steel block and its depending stud limiting such travel.

16 Claims, 11 Drawing Figures

COMPOSITE CONSTANT CONTACT SIDE BEARING FOR RAILROAD CARS

This invention relates to a composite constant contact side bearing for railroad cars, and more particularly, to a railroad car side bearing arrangement that involves a body of composite construction having an inner rigid filler block and an outer polyurethane casing that are arranged to accommodate the AAR specified preload ranges and maximum loading requirements while minimizing deflection of the bearing.

Resilient constant contact side bearings have been known for many years for application in pairs at each car truck, on either side of the car and truck bolster center bearing arrangement, and between the truck bolster and the car body bolster, to reduce car body "roll", that is, the tendency of the car body to rock or sway about its longitudinal axis (known in the industry as "rock and roll"), and to reduce truck "hunting", which is an oscillation of the truck about its pivotal connection to the car body at the center bearing connection between the two. Nevertheless, while quite a number of side bearing arrangements of the resilient constant contact type have been proposed and a number put into practice (both of the all or essentially all nonmetallic resilient elastomeric material types, and the combination types involving resilient elastomeric materials and metal such as steel in planar tube form being involved), both body roll and truck hunting continue to be problems in the railroad field. This result has been found to obtain either because the side bearing arrangements fail in use, either due to decomposition or otherwise, or they do not adequately handle body roll and truck hunting even where the side bearings do not fail or decompose during normal operating service.

The Association of American Railroads (AAR) regulations governing constant contact side bearings for railroad cars specify that they must provide a preload under the empty car condition in the range of from about 7,000 pounds to about 9,000 pounds per side bearing, with each side bearing being capable of resisting compressive loads of from about 105,000 to about 175,000 pounds per block (the latter representing a car body actuated in the familiar rock and roll pattern sufficiently to be ready to tip off its trucks).

The Applicant, in working to provide a viable resilient constant contact side bearing arrangement for railroad cars that both meets the indicated AAR criteria and operates effectively without deterioration on a long term basis, has found that while resilient constant contact side bearings must deflect under compression loads, excessive flexibility of the stress resisting bodies involved, formed from elastomeric materials, such as polyurethane, generates excessive heat to the extent that the elastomeric material deteriorates in handling the very loads it is suppose to accommodate on a long term basis; the resulting defective side bearing thus requires premature shopping of the car just to replace one or more of the car side bearings.

A principal object of the present invention is to provide a composite constant contact side bearing arrangement in which the basic side bearing body combines a rigid filler block or core about which is provided a casing of a suitable elastomeric material, such as polyurethane, which composite body precludes deflection or flexture of same that will induce the degenerating heat in operation of the side bearing, while at the same time providing the deflection or flexture that is basically required to meet AAR requirements with minimized compressive stress and change in shape factor, as well as permitting the use of a single density elastomeric material to form the body casing.

Another principal object of the present invention is to provide a composite constant contact side bearing arrangement in the form of a block like two part body comprising an elastomeric casing formed from polyurethane, and a rigid filler block enclosed within the casing, to both rigidify the side bearing body and reduce the volume of elastomeric material needed to form same, while providing a side bearing that meets the indicated AAR preloading and maximum loading requirements for car tipping resistance and car truck car hunting resistance, but without acting as a stiff restraint to the relative movement between the car body and truck that is required, as at curves and switches.

Still another principal object of the invention is to provide a constant contact side bearing of adequate resiliency but with limited flexibility, comprising a block like body in the form of an inner rigid filler block or core of hollow, metallic, one piece construction, and an outer elastomeric casing formed from polyurethane or the like that has exterior surfacing which forms the top, side, and end surfaces of the side bearing, as well as a lower or bottom wall structure that at least at the ends of the body provides much of the needed deflection under loads for offering maximum compression resistance to car body tipping action that may be occasioned as a result of body "rock and roll", with the side bearing body being arranged to provide metal to metal contact between the body filler block or core and the metal structure that mounts same on the truck bolster to effectively limit deflection of the side bearing short of overstressing and overheating of the elastomeric material that forms the side bearing casing.

Still another principal object of the invention is to provide a composite, resilient constant contact, side bearing in the form of a block like body composed of a hollow metallic filler block or core of generally quadrilateral parallelepiped configuration, but formed with a depending deflection or flexture limiting stud, which filler block or core is encased, except for the depending stud of same, in a casing formed from a single density elastomeric material such as polyurethane or its equivalent, in which the upper portion of the casing is relatively thin and thus is of limited flexture before going solid, with the casing also including an underportion at each end of the side bearing body that forms deflecting pad portions of substantial thickness dimensions that space the filler block or core stud above a metallic stop, for accommodating a predetermined flexture of the side bearing body under loads that brings the filler block or core stud into stopped relation for absorbing maximum loads with minimal flexture of the side bearing, with the casing top surfacing being arranged for essentially controlled friction characteristics for accommodating, under the requisite preloads, the necessary movement between the truck and car body that must be available during operation of the car.

Yet further objects of the invention are to provide a composite resilient constant contact side bearing arrangement for railroad cars that comprises a composite body in the form of a hollow metallic filler or block or core encased in an elastomeric casing formed from a single density polyurethane material or the like, from which protrudes downwardly from the bearing body core a metallic rigid stop component that is to limit vertical deflection of the bearing body under loads by engagement with the underlying support components for the side bearing body, which composite body may be mounted in place on the truck bolster by employing a cage for this purpose, or which may be base plate equipped for direct mounting on the truck bolster, with the resulting side bearing arrangement being economical of manufacture, convenient to install and use, and widely applicable to railroad car equipment of the type needing effective side bearing equipment for controlling relative movement of the car body and truck on a long term basis.

In accordance with the invention, the basic side bearing comprises an elongate body of generally parallelepiped configuration defining a top wall that is to be engaged by the car body bolster side bearing wear plate (which may be of either the planar or wedge type), oppositely facing, generally parallel end walls, and oppositely facing, generally parallel side walls that extend the length of the side bearing body and are disposed normally of the body end walls. The body itself comprises a rigid filler block or core of hollow metallic construction and of generally parallelepiped body configuration enclosed within a casing of elastomeric material such as a suitable polyurethane, which casing is shaped by suitable molding techniques to define the indicated body top wall, end walls and side walls. The filler block or core is further formed to define a depending tubular stud that projects from its underportion and protrudes for substantially its full length through the indicated body casing, with such casing further being formed to define on the underside of the side bearing body and at either end of same, below the filler block or core, a resilient pad portion that are of sufficient depth dimension below the underside of the filler block or core to project at least a predetermined amount below the filler block or core in excess of the projection of the filler block or core stud therefrom. The casing across the indicated top wall thereof is arranged to provide a side bearing top surfacing which has essentially controlled friction characteristics for accommodating, under the requisite preloads, the necessary movement between the truck and car body that must be available during the use of the car, as, for instance, around curves or at switches. The side bearing body of the invention is concerned with the bottom wall structure of the bearing body being arranged to accommodate the necessary preloads on the side bearing, plus the predetermined amount of flexture under additional compressive loads, and then going solid due to the engagement of the filler block or core stud with metallic stop surfaces formed by the side bearing body support, and the flexture limitations imposed on the casing upper surfaces, especially its top surfacing, due to the relatively thin thickness dimensioning of the casing along these areas of the side bearing.

The side bearing body involved is applicable to be either cage mounted or free mounted for purposes of mounting same on the truck bolster. Where the cage employed is of the conventional type, the bearing body bottom wall structure is shaped to conform with the undulating surfacing of the cage floor, and the bearing body is preferably proportioned to have its side and end walls in relatively close fit clearance relation with the corresponding side walls and end walls of the cage, and project upwardly therefrom in excess of the deflection permitted by the side bearing for engagement by the car body bolster side bearing wear plate that is to ride on same.

The side bearing body for free mounting purposes has its bottom wall structure suitably bonded to a metallic base plate proportioned for suitable affixing to the truck bolster to mount the side bearing on the bolster, as by employing bolting or riveting or the like.

Other objects, uses, and advantages will be obvious or become apparent from a consideration of the following written description and the application drawings, in which like reference numerals indicate like parts throughout the several views.

In the drawings:

FIG. 1 is a fragmental plan view of a railroad car truck equipped with cage mounted side bearings arranged in accordance with the present invention;

FIG. 2 is a diagrammatic fragmental elevational view of the truck of FIG. 1 and a portion of the car body it supports, showing the truck side frame and car body center sill in section and the truck and car body bolsters in elevation and partially broken away, with this view also forming an end view elevation of the side bearings of FIG. 1, and with a part of the truck bolster being broken away to illustrate a conventional feature of same;

However, it is to be distinctly understood that the specific drawing illustrations provided are supplied primarily to comply with the requirements of the Patent Laws, and that the invention is susceptible of modifications and variations that will be obvious to those skilled in the art, and which are intended to be covered by the appended claims.

Figure 1:
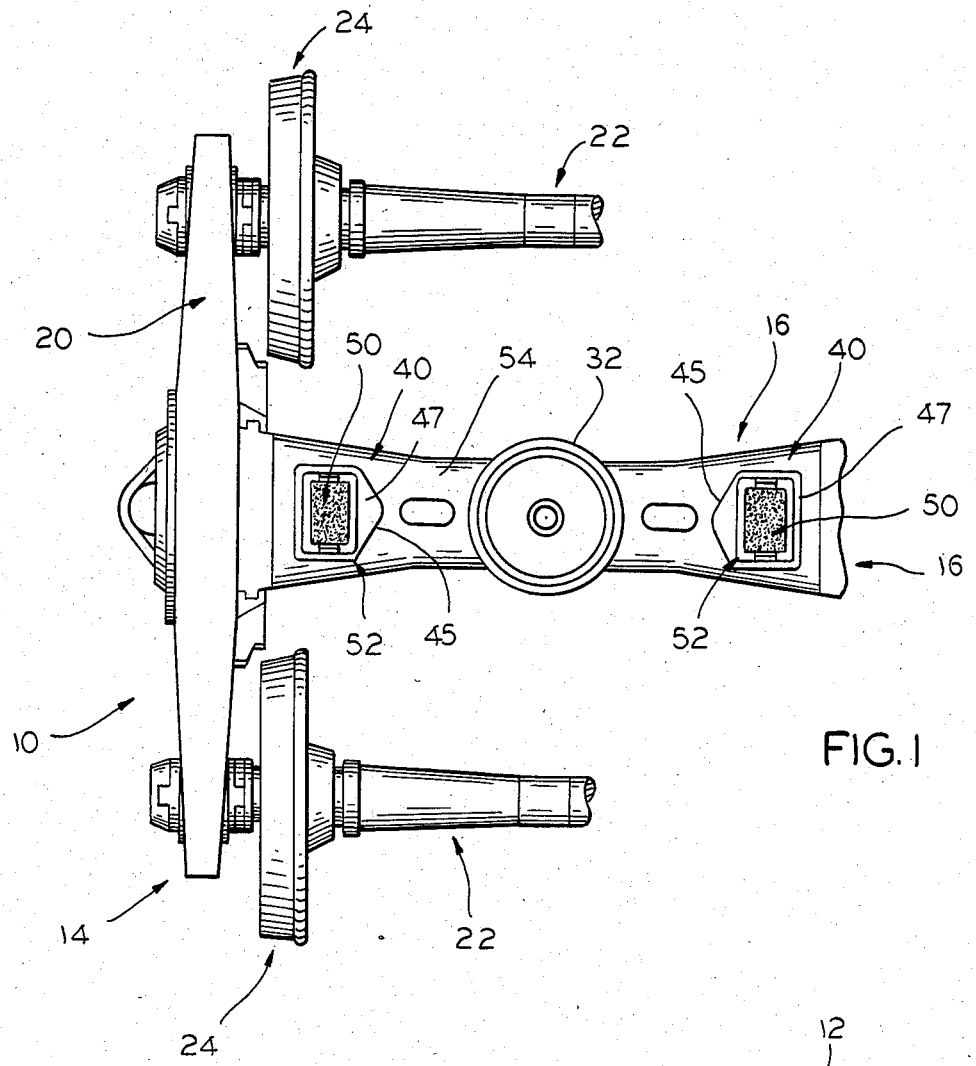
Figure 2:
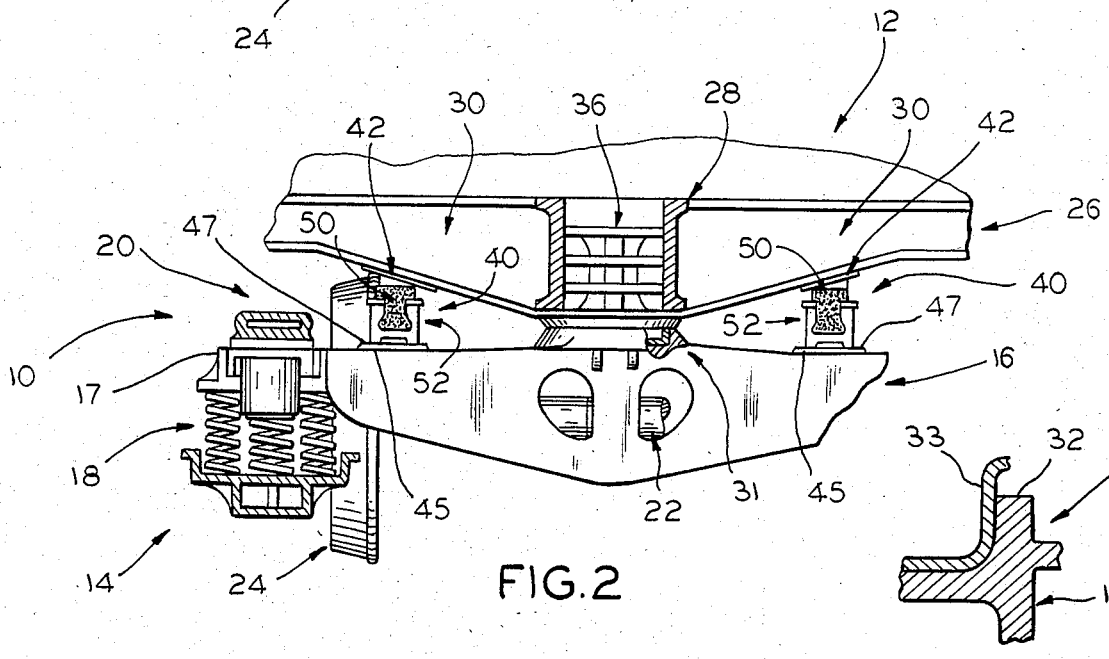
FIG. 2A is a fragmental sectional view, on an enlarged scale, of the portion of the truck bolster and car body center bearing assembly that is broken away in the showing of FIG. 2.
Figure 2A:
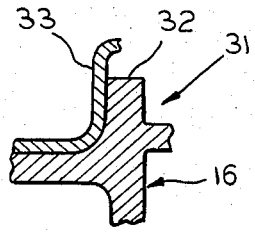

Turning first to FIGS. 1 and 2 of the drawings, reference numeral 10 generally indicates a railroad car comprising car body 12 mounted on the usual trucks 14, one of which is shown in FIGS. 1 and 2, which trucks 14 ride on the usual track rails (not shown). As is conventional, the trucks 14 each comprise a truck bolster 16 resiliently supported at its ends 17 by conventional spring devices 18 on and within the truck side frames, one of which is indicated by reference numeral 20. As usual, the truck side frames 20 are journaled on the truck axles 22, each of which has a pair of the usual flange wheels 24 fixed thereto that ride on the conventional track rails (not shown as not part of the present invention).

The car body 12 includes the usual underframe 26 that customarily comprises center sill structure 28 to which is affixed the usual body bolsters 30, cross bearers (not shown), side and end sills (not shown), and cross ties (not shown) if any.

As is further conventional, in the area of the truck bolster 16 and the car body bolsters 30, the car body 12 rests on and is swivelly connected to the truck bolster 16, with the connection of the car body 12 to the truck bolster 16 being effected conventionally utilizing a suitable center plate assembly 31 that conventionally comprises a truck bolster bowl 32 which is integral with the bolster 16, and in which is received a car body bolster center plate 33 that is suitably fixed with respect to the car body underframe center sill 28. In the form shown, the center plate 33 is integral with a suitable center filler 36, with the center plate assembly parts being suitably apertured to receive the usual kingpin (not shown) that pivotally connects the familiar basic railroad car components involved together for the usual swivelling action therebetween.

It is here pointed out that these conventional parts of the railroad car including its car body and truck are illustrated to provide the structural and operative background necessary or adviseable for a full understanding of the present invention.

Figure 3:
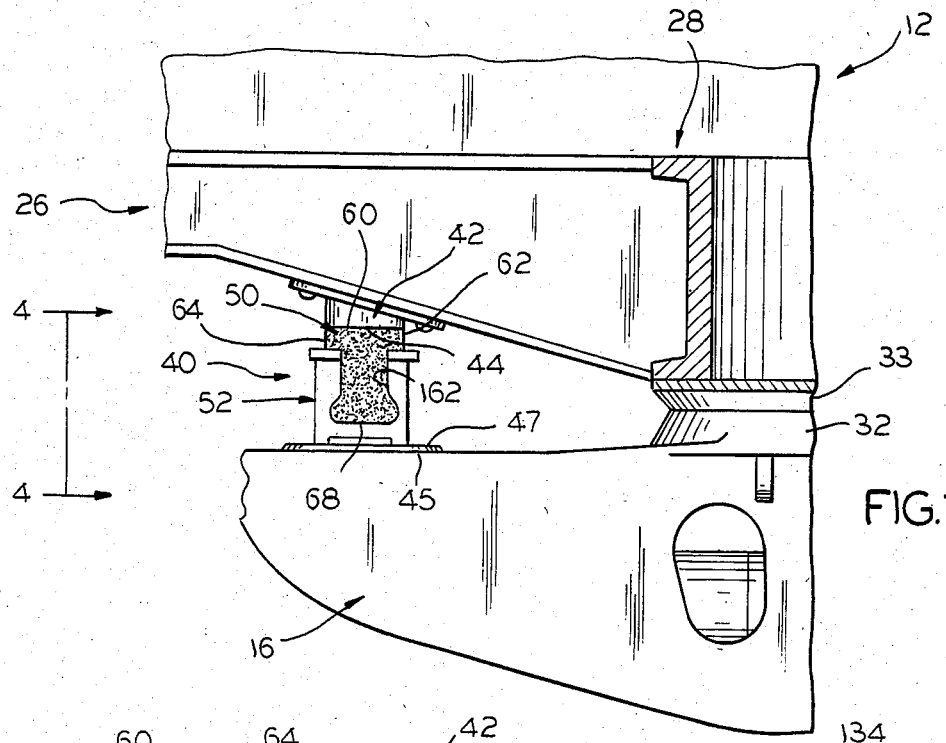
FIG. 3 is a fragmental elevational view of the car components and left hand side bearing shown in FIG. 2, with the car components being shown fragmentally, and the care mounted bearing illustrated being mounted in a conventional, commercially available cage suitably anchored to the truck bolster involved.

Mounted on the truck bolster 16 on either side of the center plate assembly 31, and intermediate the center plate assembly 31 and the portions of the bolster 16 that are spring mounted by the truck side frames 20, are the resilient constant contact side bearings 40 that represent one embodiment of the present invention, namely the cage mounted embodiment. FIG. 3 of the drawings illustrates the side bearing 40 on an enlarged scale, and in operative association with one side of the truck bolster 16 and the body bolster 30 overlying one side of same. As is well known in the art, where the railroad car involved is to be equipped with constant contact side bearings, the car body bolsters are commonly equipped with metallic wedge structures 42 defining downwardly facing wear surfaces 44 for resting on the side bearing with a predetermined preload when the car is empty, in accordance with AAR standards on this subject. In the form shown in FIGS. 2 and 3, the common wedge structure 42 defining the wear surface 44 is illustrated, but where the underside of the body bolster is horizontally disposed rather than inclined as illustrated, a horizontal planar wear plate structure is commonly employed for this purpose.

In any event, the wedge structure and the equivalent horizontal plate structure each comprise a wear plate arrangement defining a downwardly facing metallic wear surface 44 that is to have the AAR specified preload compressive engagement with the side bearing, when the car is empty and standing on level track. The wedge structure 42 is only block diagram illustrated, and it and the common horizontal plate structure are to be considered equivalent in concept of the showings of FIGS. 1–10 on this subject.

As is further well known in the art, the truck bolsters 16 are commonly formed with integral side bearing pads 45 adjacent either end of same each defining a planar upwardly facing surfacing 47 to which the respective side bearings 40 are applied.

The side bearing 40 is more specifically illustrated in the enlarged views 4–8, wherein it will be seen that the side bearing 40 comprises body 50 that is seated in the mounting cage 52, which in turn is suitably affixed to the bolster upper wall 54, and specifically, to surface 47 of the respective pads 45 that are an integral part of the bolster.

As indicated in FIGS. 1–8, the side bearing body 50 is of generally elongate parallelepiped configuration defining top wall 60, side walls 62 and 64, and end walls 66 and 68, all of which are essentially planar in configuration, and bottom wall structure 70 that is of the special configuration indicated in FIGS. 4 and 6–8. The side bearing body 50 is of composite arrangement comprising an inner rigid filler block or core 72 that preferably is of hollow metallic construction and shaped to define elongate body portion 74 that is essentially of parallelepiped configuration and that is equipped with a depending stud or prong 76 that in the form of FIGS. 1–8 is centered along the length of the filler or core 74. The filler or core body portion 74 is encased in a casing 78 that is of non-metallic elastomeric characteristics, and preferably is polyurethane of a single density material type having the hardness characteristics referred to hereinafter.

Figure 6:
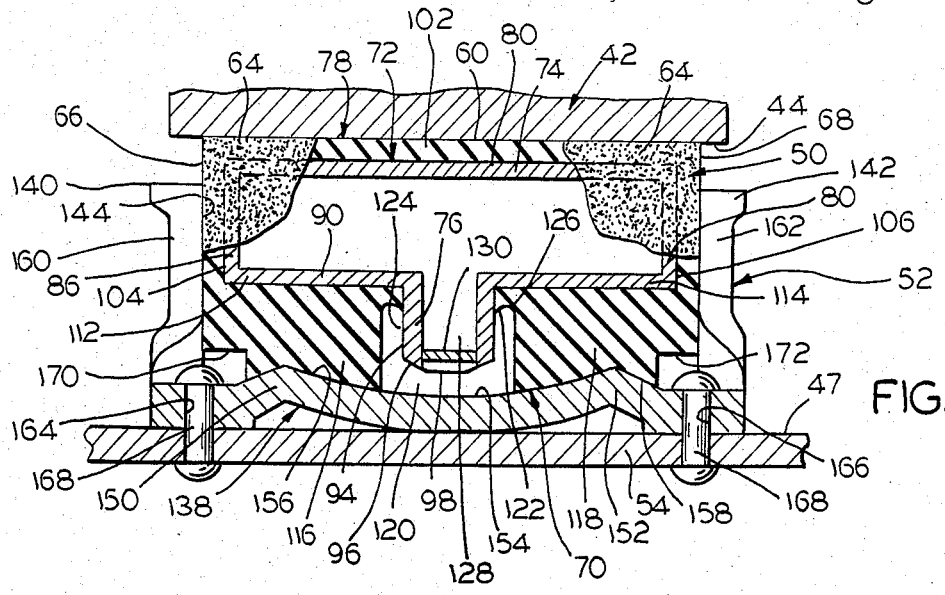
FIG. 6 is a view of the side bearing assembly shown in FIG. 4, but on an enlarged scale, and with parts broken away to expose underlying components, with the parts shown in section being sectioned essentially along line 6—6 of FIG. 5.
Figure 7:
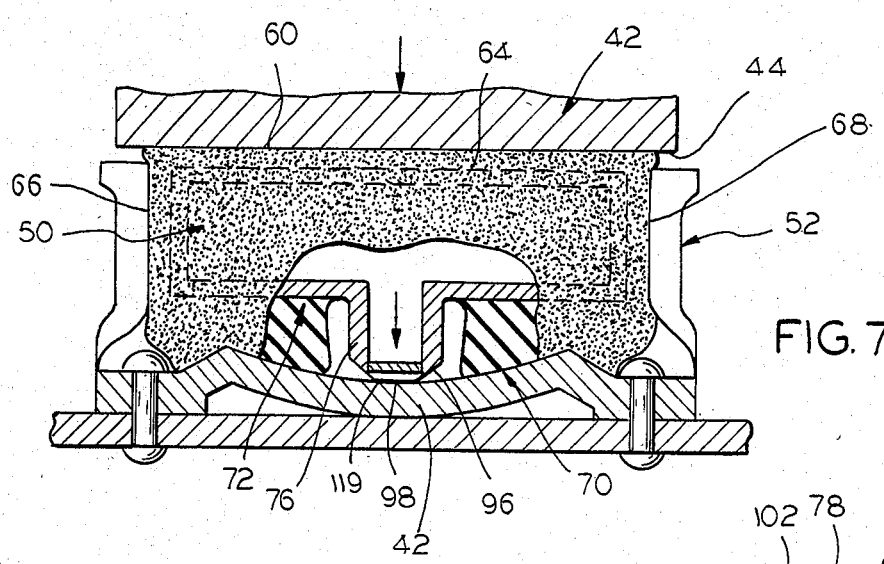
FIG. 7 is a view similar to that of FIG. 6, but showing the side bearing compressed to its full deflection travel relation, in which the side bearing stud of the side bearing core has bottomed on the floor of the cage of the side bearing.
Figure 8:
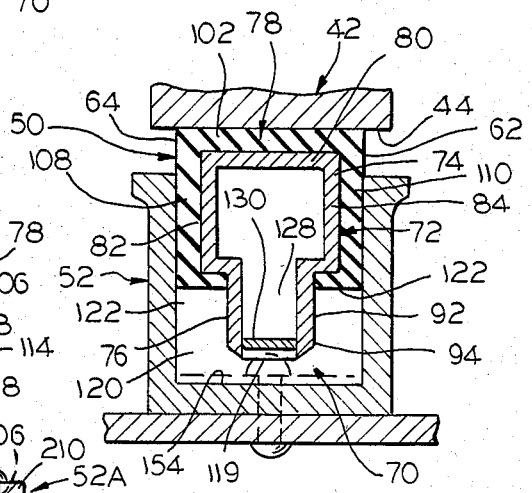
FIG. 8 is a sectional view of the side bearing arrangement shown in FIGS. 4–7, and taken substantially along line 8—8 of FIG. 5.

The filler block or core 72 is preferably formed from either C1018 steel or 1020 steel or a suitable ductile case iron (or other equivalent metallic material), and defines upper planar wall 80, planar side walls 82 and 84, end walls 86 and 88, and bottom wall 90 that give the filler block or core 72 its basic parallelepiped configuration, with the stud or prong 76 being centered with regard to the filler block or core body portion 74 and depending from the bottom wall 80 in the manner indicated in FIGS. 6–8.

The filler block or core 72 is to be rigid in character, and preferably formed from a suitable metallic substance, such as ductile cast iron or its equivalent, with the core 72 being hollow (as shown) if formed from ductile cast iron, the stud or prong 76 being similarly hollow or tubular, as indicated; where the filler block or core 72 is formed from steel, it and its stud 76 are preferably solid and lack the hollow interior illustrated. In the form shown, the stud or prong 76 is defined by cylindrical wall 92 that is integral with bottom wall 90, and has its depending end portion 94 suitably champhered as at 96, and shaped at its terminal end portion 100 to be in flush engagement with a fixed stop surfacing that is provided in accordance with the practice of the invention, as hereinafter described. Where the core 72 is formed from steel, it is solid with the external surfacing indicated.

The casing 78 that encases the filler block or core 72 is also basically of elongate parallelepiped configuration defining planar top wall 102 that is integral with end walls 104 and 106 and side walls 108 and 110. By the shaping of these walls of the casing 78, the aforereferred to body walls 60, 62 and 64, and 66 and 68 are defined.

The casing 78 below the body portion 74 of the filler block or core 72, at the respective ends 112 and 114 of same, is formed to define the respective resilient pad portions 116 and 118 that are of a thickness or depth dimension to, in the unstressed condition of the body 50, space the underside 119 of the filler block or core stud 76 well above the stop surfacing for same that is described hereinafter. As indicated in FIGS. 6–8, the casing 78 is formed, as by employing a suitable molding procedure, to encase the filler block or core 72, except for the depending stud or prong 76, with the elastomeric material involved being shaped at the underside of the body 50 to define recess 120 that extends across the width of the body 50 at its midportion on the underside of same and provides a working space for the depending stud or prong 76 in moving to provide a fixed stop for limitihg vertical deflection or flexture of the elastomeric material under rock and roll conditions, as will be hereinafter described. The casing 78 thus defines annular lip 122 that is in bonded and sealed relation with the external surfacing 124 of the stud or prong 76 about the closed end 126 of the recess 120, which, as indicated in FIGS. 6–8, is spaced below the bottom wall 90 of the filler block or core 72. The tubular nature of the stub or prong 76, where this is present, defines a bore 128 that is preferably permanently closed by a suitable plug 130 formed from a suitable plastic material and appropriately bonded in place inwardly of the stud or prong end portion 98.

Cage 52 in the form shown is commercially available from A. Stucki Company, of Pittsburgh, Pa., the cage 52 being one of those illustrated at pages 738 and 739 of the 1980 Edition of The Car & Locomotive Cyclopedia (the disclosures of which are incorporated herein by this reference). The cage 52 thus comprises upright side walls 134 and 136 that are integral with the bottom or floor wall 138 and end walls 140 and 142 to define open top chamber 144 in which the body 50 is received in close fitting relation thereto.

In the form illustrated, the floor 138 of the cage 52 is humped at 150 and 152, and concavely (cylindrical 16) surfaced at 154 to serve as seating surfaces for a pair of elastomeric blocks and a steel roller applied in between same, respectively, and within the chamber 144. As the cage 52 is a commercially available product, the bottom wall structure 70 of body 50, and specifically the undersurfacing 156 and 158, of the respective pad portions 116 and 118, is shaped to complement the corresponding portions of the cage floor wall 150 they are to engage or seat against.

In accordance with the invention, the body 50 is proportioned to seat within the cage chamber 144 in close fitting relation to the cage walls 134, 136, and 140 and 142, with a clearance on the order of 1/16th of an inch, so that the body 50 readily slips into chamber 144. Further, in the embodiment of FIGS. 1–8, the side bearing body 60 is centered within the casing 78, and the casing 78 is shaped so that the filler block or core stud or prong 76 is centered longitudinally of the body 50 and the chamber 144 whereby the stud end surfacing 98, in the unstressed relation of the side bearing, is disposed vertically above and approximately centered on the mid portion of the cage floor convex surfacing 154, for flush engagement therewith in the full deflected relation of the side bearing body 50 with respect to cage 52.

Figure 4:
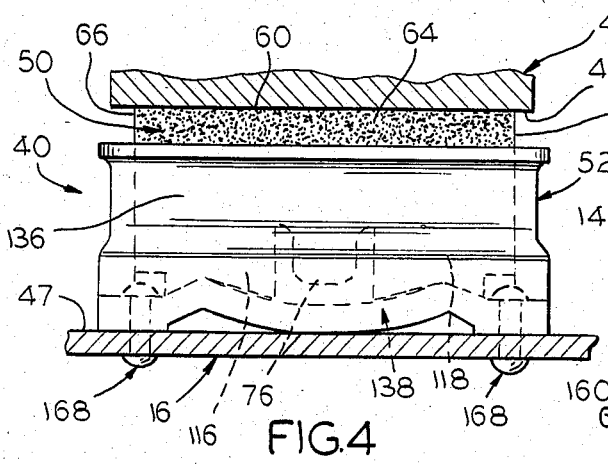
FIG. 4 is a side elevational view of the side bearing assembly shown in FIG. 3, on an enlarged scale, with the adjacent portions of the truck bolster and car body bolster wear plate being illustrated in section, and with the side bearing shown in FIG. 3 being illustrated as it would appear substantially along line 4—4 of FIG. 3.
Figure 5:
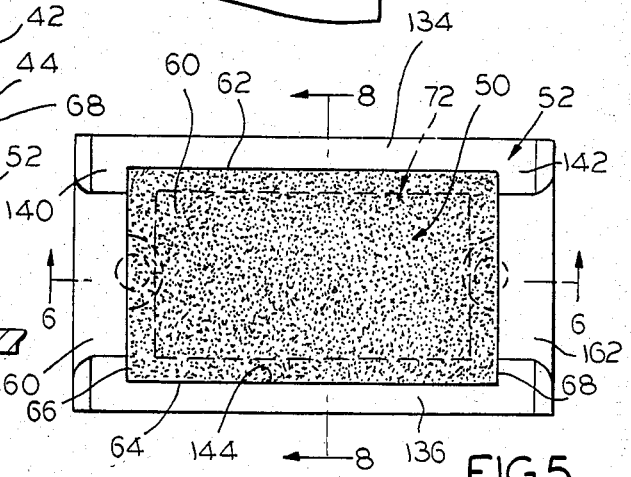
FIG. 5 is a top plan view of the side bearing and its mounting cage shown in FIG. 4.

As indicated in FIGS. 3 and 5–7, the cage end walls 140 and 142 are defined by end portions of the respective walls 134 and 136 turned inwardly toward the longitudinal center line of the chamber 144 to define the respective cage end openings 160 and 162 that expose the side bearing body end walls 66 and 68, respectively. The cage bottom or base wall 150 is suitably apertured as at 164 and 166 at either end of same to receive suitable mechanical fasteners 168, which may be rivets or nut and bolt devices, as desired, to suitably anchor the cage 52 to the top wall or roof 54 of the bolster 16, and specifically to the surfacing 47 of the respective pads 45. As indicated in FIGS. 4, 5 and 6, the pad portions 116 and 118 are recessed at the lower portion of the respective body walls 66 and 68, respectively, as at 170 and 172, to adequately space the body 50 from the fasteners 142 when the bottom wall structure 70 of the body 50 is seated as indicated in FIG. 6 against the bottom wall 138 of the cage 52.

In applying a car set of side bearings 40 to railroad car equipment of the type indicated, the car being so equipped is disposed on rails that are in essentially the same horizontal plane, and the kingpin connection at the center plate structure at the respective ends of the car is disconnected for separating the car body center plate from the bolster bowl, as needed to install the side bearings 40 at each truck 10. For each truck bolster 16, two side bearings 40 are required, and for each side bearing 40, a body 50 is received in a cage 52, and the cage 52 in question is mounted on the truck bolster 16, so as to suitably secure the cage 52 to the bolster 16 by employing fastening devices 142. Depending on the type of fastener 142 employed, for each side bearing 40 installed, the cage 52 is first mounted in place on the respective truck bolster pads 45 and then the body 52 is disposed in the chamber 144 thereof, or the body 50 is first applied to the cage chamber 144 and the cage affixed in operating position on the respective bolster pads 45. In either case, the side bearing body 50 is firmly received in the cage chamber 44 in close fitting relation thereto, and has its lower wall structure 70 seated against the cage floor 138 in the manner indicated in FIG. 6, in which position the body casing recesses 170 and 172 adequately space the side bearing body 50 from the respective fastening devices 168; as applied to the truck bolster 16, the upstanding planar top surfacing 60 of the body 50 faces the wear surfacing 44 of the overlying wedge structure 42 or the like. Assuming that the car truck bosters 16 are similarly equipped at each side bearing site represented by pad 45, the car body is then returned to reunite the center plate bearing structure 31 that is involved, with the car body bolsters resting on the respective side bearings 40, and specifically the bodies 50 thereof, by way of the wear surfaces 44, with the preloads specified by the AAR under the empty load condition which will be in the range of from about 7,000 to about 9,000 pounds per side bearing body 50. On reconnection of the kingpin and assuming both ends of the car are arranged in the same manner to have the side bearings 40 applied thereto, the car so equipped has its side bearings 40 in constant contact relation with the body thereof, and in particular, the side bearing bodies 50 are in constant contact relation with the wear surfaces 44 along their planar top surfacing 60.

In a preferred embodiment of the side bearings 40, the body 50 is dimensioned to be approximately 2¾ inches in width, 8½ inches in length, and 4¼ inches in depth measuring from the top surface 60 to the lower edges of end surfaces 66 and 68. The filler block or core 70 is preferably proportioned so that when casing 78 is applied thereto, the top wall 102 of same has a thickness dimension approximating ¼ inch, and the portions of the end walls 104 and 106, and the side walls 108 and 110, that overlie the respective end walls 86 and 88, and side walls 82 and 84, respectively, of the block or core 72 also have a thickness dimension on the order of ¼ of an inch. The undersurfacing of the casing pad portions 116 and 118 is shaped to conform to the corresponding floor surfacing 156 of the cage for complementary fit thereagainst, with the bearing filler block or core stud or prong 76 centered within the chamber 144 over concave floor portion 154. The recess 120 has a depth of approximately 1-7/16th inches measuring from the plane that includes the lowermost corners of end walls 66 and 68, with the pad portions 116 and 118 each being approximately 3⅛th inches in dimension longitudinally of the body 50 and having a minimum depth dimension that is at least five times the thickness dimension of the casing top wall 102 (approximately 1⅜ths inches in a preferred embodiment that is adapted for application to a cage 52).

The follower block or core 72 is preferably of solid metallic construction if formed from steel, or is preferably hollow in the manner indicated if formed from ductile cast iron, as already indicated. Casing 78 is preferably in the form of a single density polyurethane having a hardness in the range of from approximately Shore 65A to approximately Shore 75D, for railroad car applications in the 50 to 100 ton weight range.

Preferably the arrangement of the side bearing is such that compression stress on the body 60 does not significantly exceed about 2,000 psi, and the deflection of the bearing body under load is limited to approximately 20 percent of the height of the body 50, with 95 percent of this deflection taken up by the two pad portions 116 and 118. A preferred shape factor is 0.5 to 0.75 for this device.

It is preferred also that when the side bearings are applied to a car in the manner indicated, that the total deflection of the side bearing body 50 be limited to approximately 11/16ths of an inch, providing for a ¼ inch deflection on preloading, another 3/16ths of an inch of travel for the stud or prong to bottom against the cage floor 138 under rock and roll conditions (see FIG. 7), and including a ¼ inch deflection at the end of which the top wall of the casing 78 will go solid. The filler block or core 72 is employed to minimize the flexing of the side bearing body to void undesirable heat build ups within the elastomeric material involved during operation, under rock and roll tendencies, which heat build up has been found to degenerate the viability of the side bearing. In addition, the filler block or core 72 is made imperforate, except at the lower end of the stud or prong 76 (where hollow), to avoid deflection of the elastomeric material involved into the body core.

It is also preferable that the top surface 60 of the casing be suitably treated to have controlled antifriction characteristics, for instance, a coefficient of friction with respect to steel that will approximate 0.2 for ready sliding movement of the car body wear surface 44 relative to the top of the body 50. This arrangement comprises the aforementioned control friction characteristics at the top of the body 50.

When a car equipped with the side bearings 40 is loaded, the weight on the side bearings 40 increases correspondingly, but does not materially deflect the side bearing bodies 50. As the car moves in service, the antifriction characteristics of the bearing body surfacing 60 make for ready sliding movement of the wear surfaces 44 relative to the top of the respective side bearing bodies 50, to maintain the constant contact relationship involved as well as the truck hunting resistance offered and resistance offered to car body rock and roll tendencies, that are provided by the bearing bodies 50.

In the event that rock and roll of the car body occurs, the bodies 50 of the particular truck bolster are alternately compression stressed, and relieved. When the compression stressing reaches the desired approximate 2,000 psi maximum on the side bearing body 50, sufficient deflection has occurred to bring the end portion 98 of the side bearing stud or prong 76 in seated relation with the floor 138 of the cage 52, whereby the compressive stress is then transmitted directly through the cage to the bolster, as indicated in FIG. 7, thus avoiding excessive flexture of the bearing body 50. The arrangement of the bearing bodies 50 is such that, in connection with the side bearings 40, the bodies 50 resist maximum compressive loads in the AAR specified range of from abut 105,000 pounds to about 175,000 pounds per bearing body, with represents a car body actuated in the familiar rock and roll pattern sufficiently to be ready to tip off its trucks.

Figure 9:
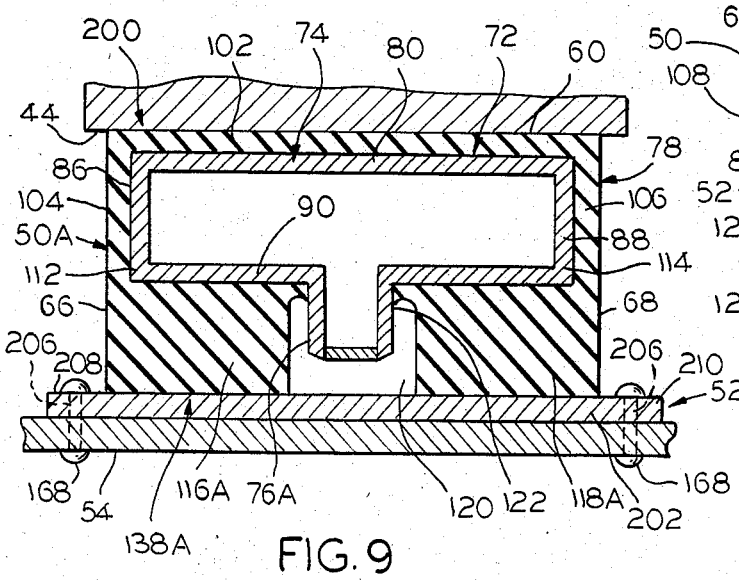
FIG. 9 is a view similar to that of FIG. 6, showing a cageless form of the invention, with the side bearing being shown in full section along its longitudinal axis.

FIG. 9 illustrates a cageless embodiment of the invention in which the side bearing 200 comprises a body 50A that is essentially the same as body 50, but has its underside 138A bonded to planar base plate 202 that is suitably fixed to the truck bolster in the same position as the cages 52, as by employing suitable fastener devices 168 applied to suitable apertures 206 formed in the opposite ends 208 and 210 of the base plate 202 and the usual apertures formed in the bolster top wall 54. In this embodiment of the invention, the planar base plate 202 takes the place of the cage 52 and the underside of the casing pad portions 116A and 118A is shaped to be planar to complement the planar shaping of the base plate 202. The recess 120 about the prong 76A remains essentially the same, as does the basic construction of the body 50A, with the side bearing 200 representing the cageless version of the invention.

Figure 10:
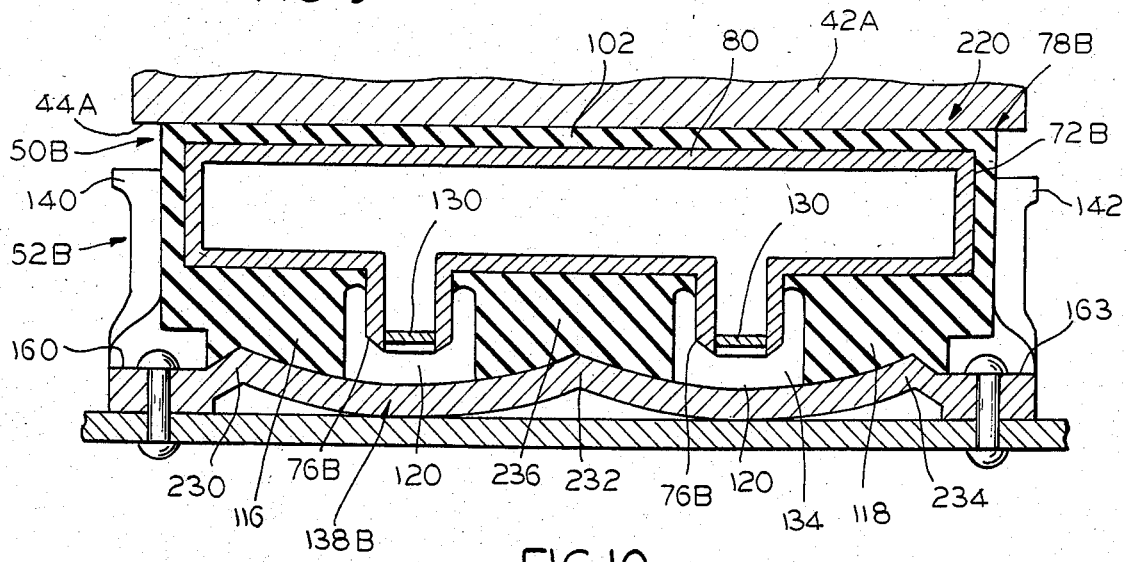
FIG. 10 is a view similar to that of FIG. 6, but illustrating a cage mounted side bearing arrangement in accordance with the present invention adapted for use in connection with heavier cars, for instance, 100 ton cars.

The side bearings 40 and 200 are arranged to fit all car sizes, but as a practical matter, three classifications of cars will be involved, namely the 50 ton, the 70 ton, and the 100 ton sizes. The bearing bodies 50 and 50A for the 50 and 70 ton cars may be of the same size dimensionally. The body sizes for 100 ton cars should be larger, with FIG. 10 illustrating a cage mounted side bearing 220 that would be appropriate for application to 100 ton cars.

The side bearing arrangement 220 comprises side bearing body 50B that is applied to cage 52B that is of the type represented by the Stucki cage 52, but proportioned for application to 100 ton cars. The cage 52B is basically the same as cage 52, as indicated by corresponding reference numerals, except that the cage floor 130A has three upward indentations 230, 232 and 234, with the middle indentation 232 being at the center portion of the cage 52B. The side bearing body 50B is basically of the same construction as body 50 (as indicated by corresponding reference numerals), with the follower block or core 72B being formed to define a pair of spaced apart studs or prongs 76B of the same type as corresponding studs or prongs of core 72, with the side bearing body casing 78B in addition to the pad portions 116 and 118 defining a pair of the recesses 120 in which the respective studs 76B are received in the same manner as in the body 50, with the indicated recesses 120 being separated by a third pad portion 236 that sits astride the center indentation 232 of the cage floor 138B, in the manner indicated in FIG. 10, and the assembled relation of the side bearing. The side bearing 220 is applied to the wear plate 42A and its wear surfacing 44A (which are proportionally enlarged in view of the greater weight of the car involved to reduce compressive stresses) in the same manner as illustrated in connection with the side bearing 40. Pad portion 236 of casing 72B serves the same functions as pad portions 116 and 118.

Polyurethane materials preferred for the side bearings herein disclosed are the polyurethane compounds 863 through 1575, offered by Gallagher Corporation of Gurnee, Ill. These materials are characterized by being durable, resistant to extremes in temperature and abrasion, and generally long lasting in use. Such material, after being compressed resiliently, relaxes rapidly when unloaded so that the bearing bodies involved return to their initial configurations for readiness to absorb the compressive stressing that will again be applied to them. Further, the flexture limitations provided by the illustrated side bearing body arrangements avoid generation of heat that can disintegrate the elastomeric material involved, and cripple the side bearings involved.

The foregoing description and the drawings are given merely to explain and illustrate the invention and the invention is not to be limited thereto, except insofar as the appended claims are so limited, since those skilled in the art who have the disclosure before them will be able to make modifications and variations therein without departing from the scope of the invention.

What is claimed is:

1. A resilient side bearing for railroad cars and adapted to be disposed in its operating position between the bolster of a truck of the car and the bolster of the end of the car body that is supported by such truck bolster, and in constant contact relation with the car body bolster, said side bearing comprising:

an elongate body defining a top wall that is to support the car body bolster, a bottom wall structure that is to be supported by the truck bolster, oppositely facing end walls, and oppositely facing side walls that extend the length of said body and are disposed normally of said end walls, said body comprising a rigid filler block enclosed within a urethane casing that defines said body top wall, end walls, and side walls, with said filler block defining a depending stud that protrudes from said casing below said filler block, said casing defining on either side of said filler block stud a resilient pad portion underlying said filler block, said casing pad portions projecting below said filler block in excess of the projection of said stud therefrom, said casing across said top wall defining a top surfacing of antifriction characteristics, and means for mounting said body on the bolster in said operating position thereof.

2. The side bearing set forth in claim 1 wherein:

said top wall being of substantially planar configuration about its perimeter.

3. The side bearing set forth in claim 1 wherein:

said filler block is substantially centered within said casing top wall, side walls, and end walls.

4. The side bearing set forth in claim 3 wherein:

said casing walls have a thickness for minimized flexture of said casing walls.

5. The side bearing set forth in claim 4 wherein:

the thickness of said casing walls approximates one quarter inch.

6. The side bearing set forth in claim 3 wherein:

said filler block and said stud are hollow.

7. The side bearing set forth in claim 6 wherein:

said filler block and said stud are of one piece construction formed from metal.

8. The side bearing set forth in claim 7 wherein:

said casing is formed from polyurethane having a hardness in the range of from about Shore 65A to about Shore 75B.

9. The side bearing set forth in claim 3 including:

a cage defining a generally quadrilateral open topped chamber, in which said body is received, including opposed side walls closely receiving said body side walls, respectively, said cage chamber further including opposed end walls that closely receive said body end walls, respectively, with said cage end walls being open along their midportions for substantially the height of said chamber, said cage defining a floor on which said body bottom wall structure is seated, said body bottom wall structure spacing said filler block stud above said cage floor, said body top wall being disposed exteriorly of said cage, said cage being formed for making same fast to the truck bolster for forming said mounting means.

10. The side bearing set forth in claim 9 wherein:

said body bottom wall structure is adhered to a mounting plate formed to seat directly on the truck bolster, with said mounting plate being formed for making said body fast to the truck bolster, for forming said mounting means.

11. The side bearing set forth in claim 3 wherein:

said filler block stud is centered along the length of said filler block.

12. The side bearing set forth in claim 3 wherein:

said filler block defines a plurality of said studs spaced apart longitudinally of said filler block, said resilient pad portions defined by said casing alternating with said studing longitudinally of said body.

13. In a railroad car including a railroad car truck including a bolster carried by the truck, with the truck wheels riding on the truck rails, a car body riding on the truck bolster, with the car body and truck including center bearing means providing support for the car body on the truck bolster, and with the car body including car body bolsters on either side of said center bearing means and disposed above the truck bolster, with each of said body bolsters including a rest structure having a flat undersurface, with said rest structures being disposed to either side of said center bearing means, and a resilient side bearing interposed between each of said rest structures and the truck bolster in constant contact relation to the respective surfacings of said rest structures in the operative position thereof for providing supplemental support for the car body on the truck bolster and for affording resistance to tilting of the car body relative to said center bearing means, the combination wherein said side bearings each comprise:

an elongate body defining a top wall that is to engage the car body bolster rest structure, a bottom wall structure that is to be supported by the truck bolster, oppositely facing end walls, and oppositely facing side walls that extend the length of said body and are disposed normally of said end walls, said body comprising a rigid filler block enclosed within a urethane casing that defines said body top wall, end walls, and side walls, with said filler block defining a depending stud that protrudes from said casing below said filler block, said casing defining on either side of said filler block stud a resilient pad portion underlying said filler block, said casing pad portions projecting below said filler block in excess of the projection of said stud therefrom, said casing across said top wall defining a top surfacing of antifriction characteristics, and means for mounting said body on the bolster in said operating position thereof.

14. The combination set forth in claim 13 wherein in said side bearings each further comprise:

said filler block being formed from metal, and said casing is formed from polyurethane having a hardness in the range of from about Shore 65A to about Shore 75B.

15. The combination set forth in claim 13 including for each said body:

a cage in which said body is received, said cage defining a generally quadrilateral open topped chamber, in which said body is closely received, including opposed side walls closely receiving said body side walls, respectively, said cage chamber further including opposed end walls that closely receive said body end walls, respectively, with said cage end walls being open along their mid portions for substantially the height of said chamber, said cage defining a floor on wihch said body bottom wall structure is seated, said body bottom wall structure of each body spacing said filler block stud thereof above the floor of the respective cages, said top wall of the respective bodies being disposed exteriorly of said cage thereof, said cage being formed for making same fast to the truck bolster for forming said mounting means thereof.

16. The combination set forth in claim 13 wherein for each said body:

said body bottom wall structure is adhered to a mounting plate formed to seat directly on the truck bolster, with said mounting plates being formed for making said bodies fast to the truck bolster for forming said mounting means thereof.

* * * * *